United States Patent [19]

Hallett et al.

[11] Patent Number: 4,855,721

[45] Date of Patent: Aug. 8, 1989

[54] ALARM APPARATUS FOR A FREEZER

[76] Inventors: Robert Hallett, 477 Laclie Street, Orillia, Ont., Canada, L4V 4R2; Edward Ketelaar, Jr., R.R. #2, Georgetown, Ont., Canada, L7G 4S5

[21] Appl. No.: 124,641

[22] Filed: Nov. 24, 1987

[51] Int. Cl.[4] ..... G08B 21/00; G08B 25/00

[52] U.S. Cl. ..... 340/585; 340/384 E; 340/661; 340/693

[58] Field of Search ..... 340/585, 693, 661, 384 E

[56] References Cited

U.S. PATENT DOCUMENTS

| | | | |
|---|---|---|---|
| 3,753,259 | 8/1973 | Donovan | 340/585 |
| 3,959,787 | 5/1976 | Messmann et al. | 340/585 |
| 4,028,688 | 6/1977 | Goleman | 340/585 |
| 4,175,262 | 11/1979 | Harakawa et al. | 340/384 E |
| 4,244,021 | 1/1981 | Chiles, III | 340/384 E |
| 4,258,359 | 3/1981 | McLamb | 340/693 |
| 4,359,679 | 11/1982 | Regan | 340/661 |
| 4,385,289 | 5/1983 | McMillan | 340/585 |
| 4,407,141 | 10/1983 | Paddock | 340/585 |
| 4,482,785 | 11/1984 | Finnegan et al. | 340/585 |
| 4,567,474 | 1/1986 | Wolin | 340/585 |

*Primary Examiner*—Glen R. Swann III

*Attorney, Agent, or Firm*—Burke-Robertson

[57] ABSTRACT

An alarm apparatus is provided for a freezer having a body and a closure member. The alarm apparatus has an electrical control unit having a power supply input. An alarm device and a temperature sensor are connected to the control unit. The temperature sensor is adapted for mounting in the freezer, for detecting temperatures exceeding a pre-set temperature. A flexible lead is provided for connecting at least two of the control unit, the alarm device and the temperature sensor together. The lead has a cross-section enabling it to extend between the lid and the body of a freezer, while permitting closure thereof. The alarm apparatus can include a second lead connecting the alarm device to the control unit, to enable the alarm device to be placed at a location remote from the freezer.

3 Claims, 3 Drawing Sheets

ALARM APPARATUS FOR A FREEZER

This invention relates to an alarm apparatus for a freezer, and it more particularly relates to an alarm apparatus suitable for a domestic freezer.

BACKGROUND OF THE INVENTION

At the present time, many households have a freezer, for storage of a variety of food. The freezers have the advantage of enabling a wide variety of food products to be stored for a long time. However, if the freezer fails, this can lead to the food being spoiled. Consequently, if a failure is not detected sufficiently early, then the entire contents of the freezer will become defrosted and will have to be disposed of.

This problem is compounded by the fact that freezers are often located in a relatively little used part of the house, so that a freezer failure can go undetected for some time. This problem is particularly acute, when one leaves the house empty for a weekend or longer, for a vacation etc. Typically, people overlook the necessity of maintaining a watch on the freezer whilst on vacation. Even if arrangements are made for someone to oversee the house, often that person will not think to check the freezer at regular intervals. Consequently, again a freezer failure can go undetected for some time.

Accordingly, it is desirable to provide an alarm apparatus, which will provide a clear warning of failure of a freezer. Such an apparatus should not require any modification of the freezer. Further, it should enable a clear indication of a freezer failure to be given to someone outside the house.

BRIEF SUMMARY OF THE INVENTION

In accordance with the present invention, there is provided an alarm apparatus, for a freezer having a body and a closure member, the alarm apparatus comprising an electrical control unit including a power supply input, an alarm device connected to the control unit, a temperature sensor connected to the control unit, which temperature sensor is adapted for mounting in a freezer for detecting temperatures exceeding a pre-set temperature, and a first, flexible lead connecting two of the control unit, the alarm device and the temperature sensor together, the first lead having a cross-section enabling the lead to extend between the body and the closure member of the freezer whilst permitting closure thereof.

The control unit can be located either outside or inside the freezer, but it is preferred for the control unit to be located outside the freezer. With the control unit outside, it can readily be connected to a conventional A.C. socket. A control unit located within the freezer could not so readily be connected to an electrical socket, and may have to rely on a battery as a source of power. The control unit can have a 9 volt D.C. input. In this case, a second lead would be provided for connecting to a standard domestic A.C. socket.

Further, although the control unit and the alarm device can be mounted together, it is preferred in many cases to have them mounted separately. Thus, the alarm device can be connected to the control unit by a third lead. Connection of the various components together by appropriate leads enables the apparatus to be readily fitted. For most installations, it should be sufficient to provide standard size leads of sufficient length to enable the user to arrange the components as desired.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DETAILED DESCRIPTION OF THE PREFERRED EMBODIMENTS

Figure 1:
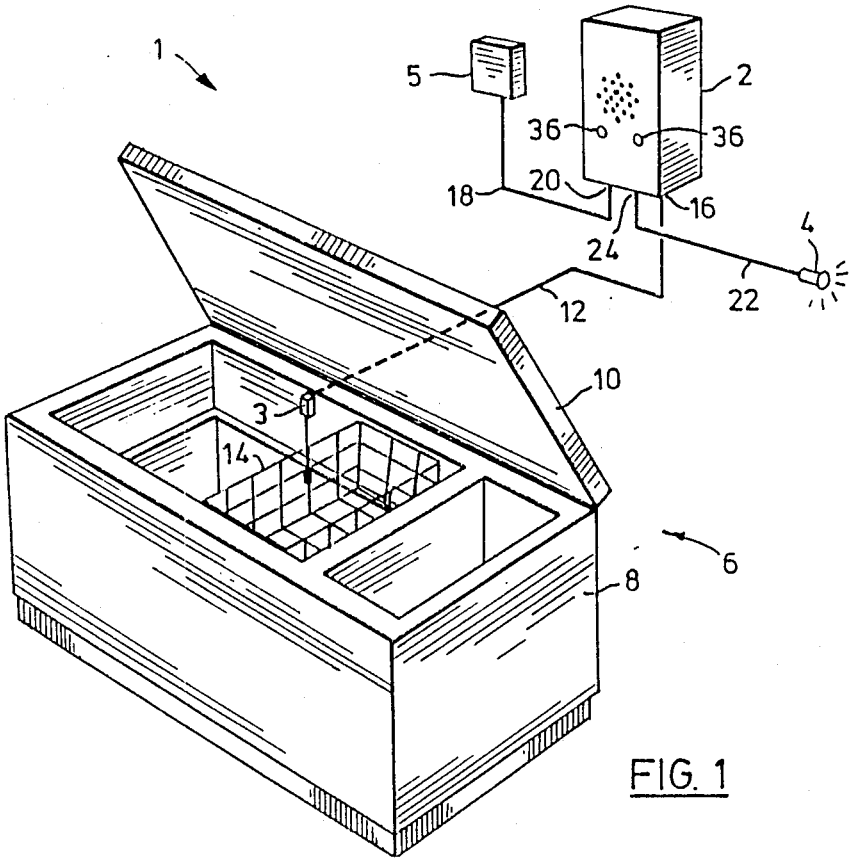
FIG. 1 is a perspective view of an alarm apparatus according to the present invention, shown fitted in a freezer.

With reference to FIG. 1, the apparatus as a whole is denoted by the reference 1. The apparatus 1 has a control unit 2, a sensor 3, and an alarm or warning light 4. Further, a transformer 5 is provided for the control unit 2.

The sensor 3 is shown mounted in a freezer, shown at 6. The freezer 6 includes a body 8 and a lid 10. The lid 10 is the closure member of the freezer 6, and in other freezer designs would be formed as a door. Conventionally, at the present time, such a lid 10 has a sealing strip, which has a certain degree of resilience.

A first lead 12 extends between the sensor 3 and the control unit 2. As shown, in known manner, the freezer 6 includes a wire basket 14. To locate the sensor 3, part of the lead 12 is wrapped around the basket 14. The first lead 12 includes two conductors, and is of small cross-section. This enables the lead 12 to extend between the lid 10 and body 8, when the freezer 6 is closed; the seal of the lid 10 deforms sufficiently, to maintain a good seal.

The sensor 3 is integral with the lead 12. The other end of the lead 12 is provided with a plug 16, for plugging it into the control unit 2.

Similarly, the transformer 5 is provided with a second lead 18, including a plug 20 at one end thereof. The plug 20 again is plugged into the control unit 2. The warning light 4 is connected to a third lead 22, which includes a respective third plug 24.

The transformer 5 can be a conventional transformer for converting a household A.C. supply to a 9 volt D.C. supply. It should be capable of accepting 117 volts A.C. at 60 HZ at the input, whilst delivering a 9 volt D.C. output at 200 MA. It should preferably be UL and CSA approved.

The warning light 4 is a light emitting diode (LED).

Figure 3:
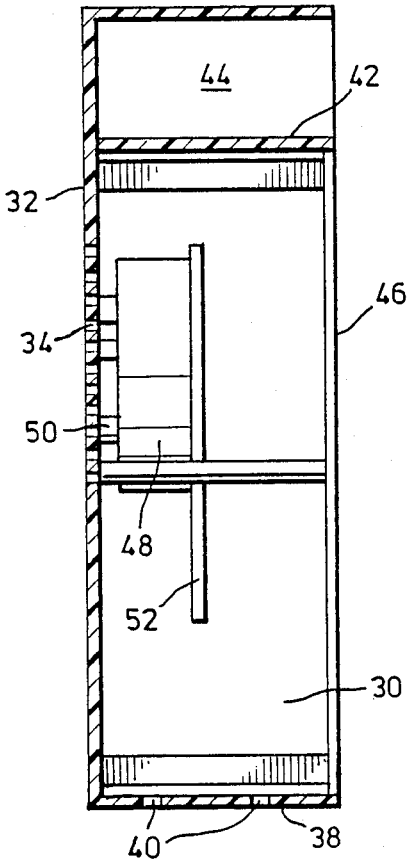
FIG. 3 shows a vertical, sectional view of the control unit.
Figure 4:
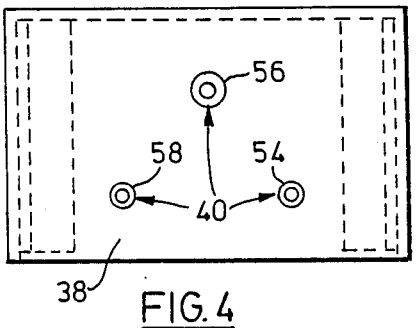
FIG. 4 shows an end view of the control unit.

Turning to the control unit 2, the arrangement of the components in the control unit 2 is shown in FIGS. 3 and 4. It is to be appreciated that this arrangement is merely preferred, and that the size of the body and the arrangement of the components can be varied, wihout affecting operation of it.

The control unit 2 has a housing 30, which is a generally rectangular prism. The housing 30 includes a front wall 32 provided with a number of perforations 34, for an audible alarm. It also includes two openings 36, for the two LED's. A bottom wall 38 includes openings 40, for connection sockets. As shown in FIG. 3, a partition 42 separates a battery compartment 44, from the rest of the interior of the housing 30. A plastic cover plate 46 covers off the rear of the housing 30.

Within the housing 30, a piezo electric alarm 48 is mounted on standoffs 50 adjacent the perforations 34, for producing an audible alarm. The piezo alarm 48 also serves as a support for a printed circuit board 52.

As shown in FIG. 4, in the openings 40 in the bottom wall 38, there are three sockets. A first socket 54 is provided for the plug 16 for the sensor 3. Corresponding second and third sockets 56, 58 are provided for the second and third plugs 20, 24.

Figure 2:
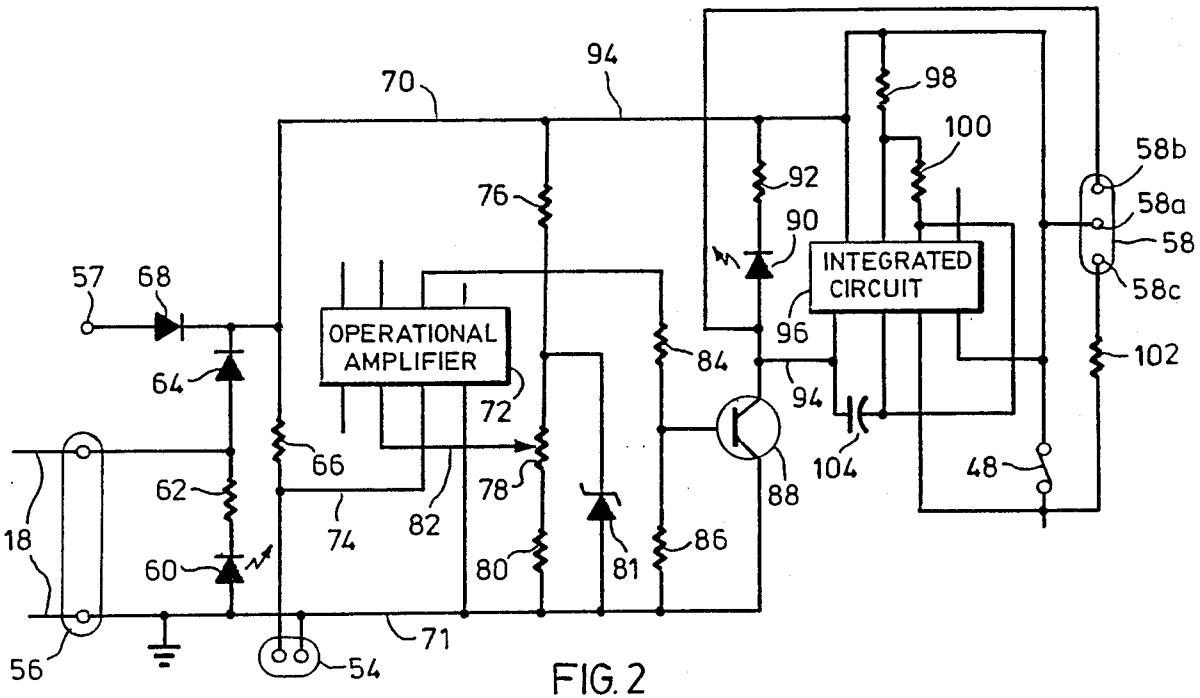
FIG. 2 shows a circuit diagram of the control unit.

Turning to the circuit diagram of FIG. 2, the second socket 56, for the power supply, has its negative side connected to a common negative line 71. The positive side of the socket 56 is connected through a diode 64 to a positive line 70. There is also a connection between the positive and negative inputs of the socket 56 through a second light emitting diode 60 and a first resistor 62 in series. The second light emitting diode 60 is located in the left hand aperture 36 as viewed in FIG. 1.

As shown at 57, a battery supply connection is connected to the positive line 70. A negative battery connection (not shown) is connected directly to the line 71, whilst the positive connection is through a diode 68. The positive line 70 is connected through a second resistor 66 to the first socket 54 for the sensor 3.

An integrated circuit operational amplifier 72 is connected to the positive and negative lines 70, 71 as shown. It also has an input 74 connected to the junction between the second resistor 66 and the socket 54, so that the voltage generated across the sensor 3 is input to the operational amplifier 72.

A third resistor 76 is connected in series with a variable resistor 78 and a fourth resistor 80, between the positive and negative lines 70, 71. A zener diode 81 is connected and parallel across the two resistors 78, 80. An input line 82 is connected between the operational amplifier 72 and the variable resistor 78 as shown. This enables the operational amplifier 72 to act as a comparator, which compares the fixed voltage generated at the variable resistor 78 by the zener diode 81, to the voltage across the sensor 3.

An output of the operational amplifier 72 is connected via fifth and sixth resistors 84, 86 to the negative line 71, with the base of a transistor 88 connected to the junction between the two resistors 84, 86.

A third light emitting diode 90 and a seventh resistor 92 are connected in series between the positive line 70 and the collector of the transistor 88. The third light emitting diode 90 is located to the right hand aperture 36 of the housing 30, shown in FIG. 1.

Line 94 provides a connection to a timer circuit including an LM555 integrated circuit 96. This is connected to resistors 98, 100 and 102 and a capacitor 104 in known manner.

The third, output socket 58 has three output pins **58*a*, 58*b* and 58*c*. 58*a* is a common terminal that is connected to the positive line 70. Terminal 58*b* provides a fixed or continuous output, which can be used if desired, possibly in conjunction with a buzzer, warning light 4 or other alarm that optionally includes its own timer or intermittent circuit. Terminal 58*c* provides an intermittent output, determined by the timer circuit 96 and can be connected to the light 4** or other alarm device, to provide an intermittent audible or visual alarm.

The timer circuit enables a simple piezo electric alarm 48 to be used, whilst still having an intermittent output. The alarm 48 is effectively connected across the terminals **58*a*, 58*c*, to provide it without an intermittent output. Where an intermittent output is not desired, or the alarm device includes its own intermittent circuit, the timer circuit could be eliminated and a two terminal socket connected to lines 58**.

In use, the apparatus 1 is mounted as shown in FIG. 1. The sensor 3 is located within the freezer 6, either with the lead 12 wrapped around the wire basket 14, or unwrapped. The transformer 5 is connected to the control unit 2 and plugged into a standard socket. The warning light 4 is placed at a suitable location, where it can be seen, and connected to the control unit 2. The control unit 2 itself is mounted at any suitable location adjacent the freezer 6. When powered, the second light emitting diode 60 is illuminated, giving an indication that the apparatus is in operation.

The apparatus 1 then monitors the temperature in the freezer 6. This is achieved by comparing the output of the sensor 3 with the voltage on the input line 82. If the voltage of the sensor 3 equals or exceeds the fixed voltage on line 82, then the output of the operational amplifier 72 goes to 9 volts. This turns on the transistor 88, which in turn turns on the piezo electric alarm 48. The alarm 48 gives an audible alarm. Simultaneously, the third light emitting diode 90 on the front of the control unit 2 is turned on.

Thus, the control unit 2 by itself provides both an audible and a visual alarm. However, the output socket 58 is provided, so that an additional alarm or warning can be given remote from the control unit 2. The output at socket 58 is 9 volts when activated. As shown, this is connected to the first light emitting diode of the warning light 4, to give a visual warning, which will be pulsed or constant depending on which socket **58*b*, 58*c* is used. Alternatively, this socket 58** could be connected to another alarm device or to a 9 volt relay, which turns on a 120 volt A.C. outlet.

The warning light 4 can be placed at any suitable location. For example, it is common when a householders goes on vacation to arrange for a neighbour to maintain a watch on the house. In this case, the warning light 4 could be placed in a basement window, or other window adjacent the freezer. Then, if the freezer fails, the light will be illuminated, and the neighbour will be given a warning, without having to enter the house. Appropriate action can then be taken.

The battery connection 57 is provided solely as a backup to the main power supply. One of the principal sources of failure of the freezer is failure of the electrical supply. Accordingly, if this occurs, the apparatus 1 should still be active. Preferrably, a 9 volt alkaline battery is used. Then, a warning will be given, if the power supply fails. This also serves to keep the apparatus 1 active, even if the user accidentally forgets to plug in the transformer 5.

To test if the apparatus 1 is working correctly, one can simply remove the sensor 3 from the freezer 6. The sensor 3 is then allowed to warm up sufficiently to switch on the apparatus. One can then check that the warning lights 4, 90 and the piezo electric alarm 48 are functioning correctly.

The various components of the apparatus can be compact. This makes the apparatus 1 easy to install and transfer from one freezer to another. The sensor 3 can be quite compact, and take up little space in the freezer.

By way of example, in the following table, a list is given of suggested components for the apparatus:

TABLE 1

| PARTS LIST FOR FREEZER ALARM | |
|---|---|
| Diode 64 | IN4004 DIODE |
| Diode 68 | IN4004 DIODE |
| Zener diode 81 | IN4733 51 V ZENER DIODE |
| Operational Amplifier 72 | LM741 OP. AMP. |
| Temperature sensor 3 | LM335Z TEMPERATURE SENSOR |
| Integrated circuit 96 | LM555 TIMER |
| Transistor 88 | 2N2222 A NPN TRANSISTOR |
| 1st Resistor 62 | 470 OHM ¼ W. 5% |
| 2nd Resistor 66 | 5.6K OHM ¼ W. 5% |
| 3rd Resistor 76 | 1K OHM ¼ W. 5% |
| 4th Resistor 80 | 1K OHM ¼ W. 5% |
| 5th Resistor 84 | 12K OHM ¼ W. 5% |
| 6th Resistor 86 | 3.9K OHM ¼ W. 5% |
| 7th Resistor 92 | 220 OHM ¼ W. 5% |
| 8th Resistor 98 | 2.2 M OHM ¼ W. 5% |
| 9th Resistor 100 | 2.2 M OHM ¼ W. 5% |
| 10th Resistor 102 | 470 OHM ¼ W. 5% |
| Variable Resistor 78 | 1K OHM ¾ W. 15 TURN POT |
| Transformer 5 | 9 V. D.C. 200 MA. O/P 117 VAC-60 HZ 1/P WITH 5.5 m/m POLARIZED PLUG |
| Socket 54 | 3/32 JACK 2 CONDUCTOR SUB-MINI |
| Socket 56 | 5.5 m/m × 2.1 m/m JACK |
| Socket 58 | ⅛ JACK 3 CONDUCTOR MINI |
| First LED 4 | RED T1 ¾ FLASHING |
| Second LED 60 | RED T1 ¾ |
| Third LED 90 | GREEN T1 ¾ |

We claim:

1. An alarm apparatus, for a freezer having a body and a closure member, the alarm apparatus comprising:

(a) an electrical control unit having a housing and located outside the freezer and including a power supply input;

(b) an alarm device remote from and connected to the control unit by a first flexible lead;

(c) a temperature sensor connected to the control unit, which temperature sensor is adapted for mounting in the freezer, for detecting temperatures exceeding a pre-set temperature; and (d) a second flexible lead connecting the control unit to the temperature sensor, the second lead having a cross-section enabling the lead to extend between the body and the closure member of the freezer whilst permitting closure thereof; and wherein said control unit includes:

(i) positive and negative lines connected to the power supply input, an operational amplifier connected between the positive and negative lines, which operational amplifier includes a sensor input connected to the temperature sensor, a reference input connected to a reference voltage source, and an output; and wherein the control unit includes a first resistor and a light emitting diode connected in series between the positive and negative lines, to provide an indication that the control unit is operative;

(ii) a second resistor and a detector input for the temperature sensor, connected in series between the positive and negative lines, with the sensor input of the operational amplifier connected to a junction between the first resistor and the detector input;

(iii) a third resistor, a variable resistor and a fourth resistor connected in series between the positive and negative lines, a zener diode, which is connected between the third resistor and the negative line parallel to the variable resistor and the fourth resistor, with the reference voltage input of the operational amplifier being connected to the variable resistor; and (iv) fifth and sixth resistors connected in series between an output of the operational amplifier and the negative line, a base of an output transistor being connected to a junction between the fifth and sixth resistors, the emitter of the output transistor being connected to the negative line, and a control unit output being connected between the positive line and the collector of the transistor, for connection to the alarm device; and (v) an integrated circuit timer connected to the positive line and the collector of the transistor, and wherein the control unit output includes a common terminal connected to the collector of the transistor, a continuous output terminal connected to the positive line and an intermittent output terminal connected to the integrated circuit timer.

2. An alarm apparatus as claimed in claim 1 wherein the control unit includes a light emitting diode and a seventh resistor connected in series across the control unit output, with the light emitting diode being mounted in an aperture of the housing to provide a visual alarm.

3. An alarm apparatus as claimed in claim 1 wherein the control unit includes a first light emitting diode and a corresponding resistor connected in series between the positive and negative lines, and a second light emitting diode and a corresponding resistor connected in series across the control unit output, with the first and second light emitting diodes being mounted in apertures in the housing.

* * * * *